United States Patent [19]

Pichon

[11] Patent Number: 4,672,781

[45] Date of Patent: Jun. 16, 1987

[54] CORNICE FOR BRIDGE, VIADUCT, OR THE LIKE

[75] Inventor: Joseph Pichon, Decines, France

[73] Assignee: Societe Anonyme Dite "L'Equipement Routier", Meyzieu, France

[21] Appl. No.: 752,305

[22] Filed: Jul. 3, 1985

[30] Foreign Application Priority Data

Jul. 4, 1984 [FR] France ..... 84 11049
Oct. 19, 1984 [FR] France ..... 84 16459

[51] Int. Cl.[4] ..... E01D 19/10

[52] U.S. Cl. ..... 52/94; 52/73; 52/718.1; 14/1

[58] Field of Search ..... 52/718, 717, 73, 94; 14/1, 73

[56] References Cited

U.S. PATENT DOCUMENTS

| | | | |
|---|---|---|---|
| 2,246,720 | 6/1941 | Churchill | 52/718.1 |
| 2,473,400 | 6/1949 | Waara | 52/718.1 |
| 2,780,329 | 2/1957 | Bedford | 52/718.1 |
| 2,812,559 | 11/1957 | McCarran | 52/717.1 |
| 3,456,406 | 7/1969 | Bransford | 52/94 |
| 3,738,068 | 6/1973 | Attaway | 52/718 |
| 4,363,839 | 12/1982 | Watanabe | 52/717.1 |

FOREIGN PATENT DOCUMENTS

| | | | |
|---|---|---|---|
| 932270 | 7/1963 | United Kingdom | 52/718 |

*Primary Examiner*—John E. Murtagh
*Attorney, Agent, or Firm*—Karl F. Ross; Herbert Dubno; Andrew Wilford

[57] ABSTRACT

A cornice for a construction work having an upright surface has a plurality of similar elongated panels of like section and predetermined length. These panels are laterally concave and each have a pair of parallel longitudinal edges and opposite longitudinal ends. A plurality of respective mounts each generally complementary to the concave section of the panels are anchored on the surface spaced apart by a distance equal to the length of the panels. Interengaging formations on the mounts and on the edges of the panels allow the panel edges to be hooked to the mounts. A tensioning device secures the respective panel snugly to the respective mount. Each mount comprises an outer mount member of a convex shape complementary to the concave section of the panels and an inner bracket fixed on the outer member. The anchoring device is secured to the inner bracket.

16 Claims, 10 Drawing Figures

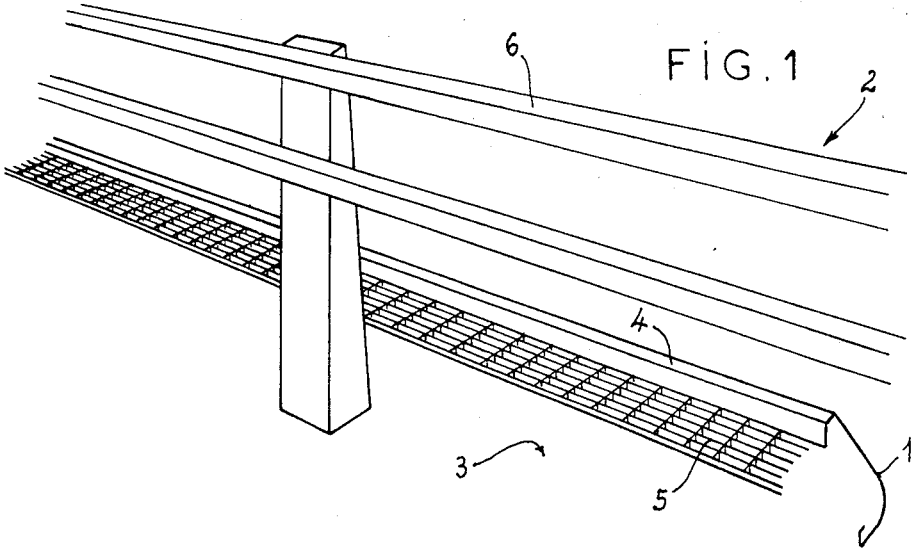
FIG. 1
FIG. 2
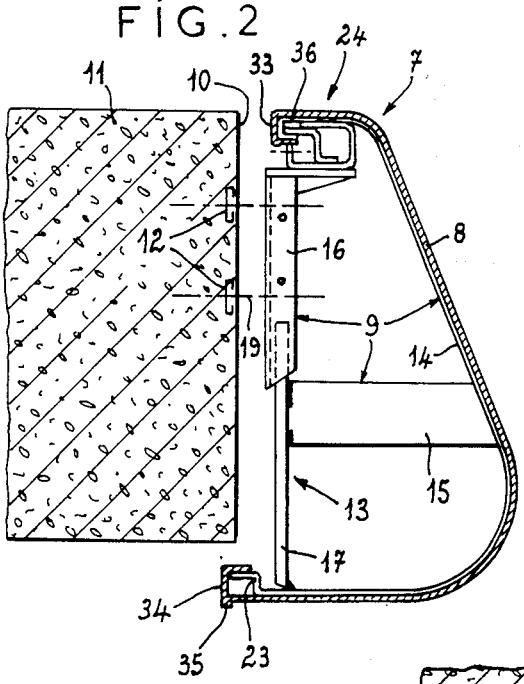
FIG. 3
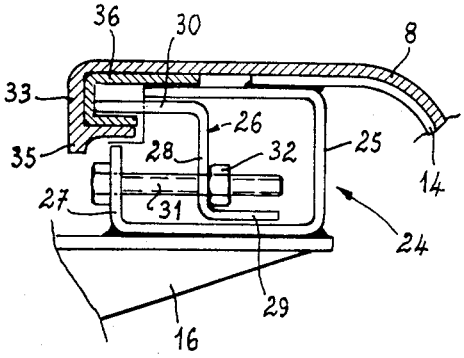
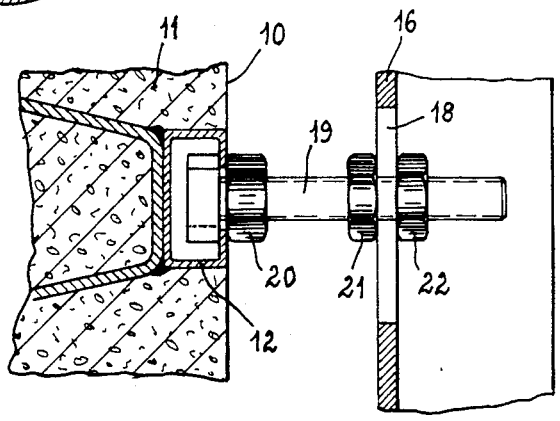
FIG. 4

CORNICE FOR BRIDGE, VIADUCT, OR THE LIKE

FIELD OF THE INVENTION

The present invention relates to a cornice for a public work or construction project. More particularly this invention concerns a prefabricated cornice for use on a bridge, viaduct, aqueduct, retaining wall, or the like.

BACKGROUND OF THE INVENTION

A construction project such as a bridge is usually detailed at its edges by a cornice that is principally decorative, although it might also function to enclose and protect piping, a drainage gutter, or the like. The cornice is typically mounted at the upper edge of a vertical surface which in this type of construction is normally itself formed of reinforced concrete.

Casting the cornice in situ is an extremely difficult job, and mounting precast concrete cornice sections on the project is also extremely expensive and time-consuming. Both solutions require that the structure itself be made sufficiently strong to carry the considerable weight of the cornice thereby adding to costs.

Hence it is known to make the cornice up of discrete sections of shaped panels, as in curtain-wall construction. This type of cornice is, nonetheless, still quite difficult to hang correctly. When the structure on which it is to be mounted is slightly out of plumb or does not otherwise conform exactly to the desired shape, as is common in large-scale projects where close tolerances are not critical, it becomes very difficult to mount the cornice in place, keeping it straight and plumb. Furthermore the fairly delicate cornice is often damaged in later phases of construction when installed at the original pour, so that patching or replacing sections of it become necessary

OBJECTS OF THE INVENTION

It is therefore an object of the present invention to provide an improved cornice for a construction project Another object is the provision of such a cornice for a construction project which overcomes the above-given disadvantages, that is which is not heavy, which is easy to install even on an out-of-true surface, and which can be installed after the rest of the job is complete so it is not damaged.

SUMMARY OF THE INVENTION

A cornice for a construction work having an upright surface according to the invention has a plurality of similar elongated panels of like section and predetermined length. These panels are laterally concave and each have a pair of parallel longitudinal edges and opposite longitudinal ends. A plurality of respective mounts each generally complementary to the concave section of the panels are anchored on the surface spaced apart by a distance equal to the length of the panels. Interengaging formations on the mounts and on the edges of the panels allow the panel edges to be hooked to the mounts. A tensioning device secures the respective panel snugly to the respective mount.

This tensioning device is accessible from atop the construction work, so that the entire cornice can be installed from this location. This eliminates the necessity of using expensive scaffoldings or cranes, and makes subsequent repair, if necessary, fairly easy.

According to another feature of this invention each mount comprises an outer mount member of a convex shape complementary to the concave section of the panels and an inner bracket fixed on the outer member. The anchoring device is secured to the inner bracket and the formations are in part on the outer mount member. In addition each bracket is formed with at least one vertically elongated and horizontally throughgoing slot and the anchoring device includes a bolt having a head captured in but horizontally slidable along a groove in the surface and a threaded shank projecting horizontally and transversely therefrom through the respective slot. Nuts threaded on the shank fix the bolt in the groove and fix the bracket on the shank. Thus the bracket can move transversely both horizontally and vertically on the bolt and the bolt can move longitudinally in the groove for three-dimensional adjustability.

In accordance with this invention the formations on the panels include bent-over inwardly open edge portions which may be lined by respective inserts of substantially greater rigidity than the panel engaging the formations of the respective mounts. The outer members are upright and each have a lower end engaged in one of the respective bent-over edge portions and the tensioning units each include a tensioning part displaceable on the mount and engaging in the other bent-over edge portion of the respective panel for displacing the respective one edge portions on the mounts. In this case respective threaded members accessible from the construction work are operatively engaged between the mounts and the tensioning parts for relatively displacing same.

It is also within the scope of this invention when the tensioning device serves to relatively displace each outer member and the respective bracket horizontally and transversely, in which case the formations of the mount are on the bracket. A threaded shaft fixed in one of the bracket and outer member is engaged through the other of the bracket and outer member, and nuts carried on the shaft are engageable with the other of the bracket and outer member to allow the outer member and bracket to be relatively displaced but solidly locked together once in position.

Spacers may be provided between the mount and the surface and each panel can be formed with an inwardly open longitudinal groove in which case the cornice also has bolts captured in the grooves and secured in the mounts for holding the panels on the mounts. The panels can be of sheet metal or of a synthetic resin. Each panel is not substantially deformed by the tensioning means but instead has a shape which is substantially the shape it is to have when secured by the tensioning means to the respective mounts.

DESCRIPTION OF THE DRAWING

The above and other features and advantages will become more readily apparent from the following, it being understood that any feature described with reference to one embodiment of the invention can be used where possible with any other embodiment. In the accompanying drawing:

FIG. 1 is a perspective view generally illustrating a cornice according to this invention;

FIG. 2 is a vertical cross section showing details of a first cornice in accordance with the present invention;

FIG. 3 is a detail view of the tensioning arrangement of the cornice of FIG. 2;

FIG. 4 is a large-scale detail view of how the anchor of FIG. 2 is mounted;

SPECIFIC DESCRIPTION

Figure 5:
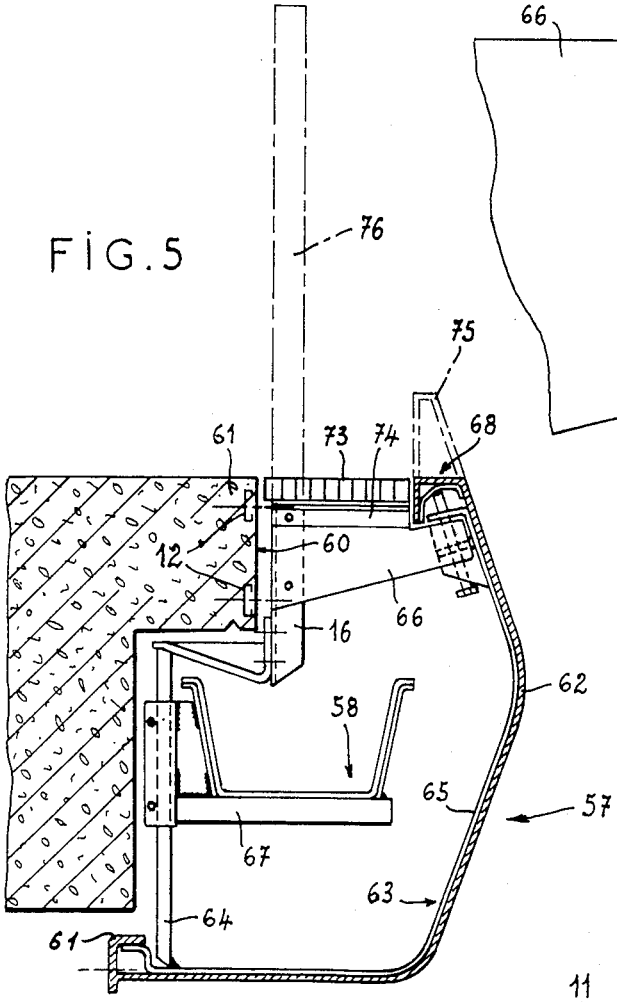
FIG. 5 is a vertical cross section through a second cornice according to this invention.

As seen in FIG. 1 a construction project or public work 2 according to this invention comprises a concrete sidewalk 3 having a guard rail 6. A cornice 1 according to the invention forms a raised kick edge 4 at the far side of a gutter grate 5 at the edge of the walk 3. Obviously this cornice 1 could also be mounted at the edge of a roof, aqueduct, or any other structure needing some permanent edge detailing.

As seen in FIG. 2 a typical cornice 7 according to this invention basically comprises a cover plate 8 carried on at least two identical mounts 9 spaced apart longitudinally, that is perpendicular to the plane of the view in FIG. 2, and secured to the upright side face 10 of a concrete slab 11 which can for example form the walk 3. The cover plate 8 is profiled and is relatively thin and even somewhat flexible. It can be made of sheet metal such as galvanized steel or anodized aluminum, or of a synthetic resin such as a tinted stratified polyester reinforced with glass fibers. This plate 8 is therefore relatively noncorrosible and can have virtually any desired color, surface texture, or section.

Each mount 9 basically comprises a bracket 13 to which is secured a metal bar 14 having a shape complementary to the interior of the panel 8, with a reinforcing strut 15 extending horizontally and transversely between the bracket 13 and the shaped bar 14. The bracket 13 itself comprises an upper standard part 16, a latching or tightening unit 24 atop the part 16 and connected to the upper end of the respective bar 14, and a lower part 17 carried at the bottom end of the part 16 and secured to the lower end of the bar 14. The part 16 is, as mentioned above, standard, and the other elements 14, 15, and 17 correspond to the shape of the panel 8 to be used.

As seen in FIG. 4, the part 16 is of U-section open away from the face 10 and is formed in its base web with at least two vertical slots 18 through which engage bolts 19 having heads captured in channels 12 embedded in the slab 10. These anchor channels 12 are secured to the reinforcement of the slab 11 and extend a modest distance in the longitudinal direction of the cornice 7. The respective bolt 19 is secured in the channel 12 by a first nut 20 and two other such nuts 21 and 22 embrace the web of the part 16 to lock it in place on the slab 11. Thus the bolt 19 itself can be adjusted longitudinally and horizontally by sliding it along the channel 12, the bracket part 16 can be adjusted transversely and horizontally by screwing the nuts 21 and 22 out or in, and the bracket part 16 can further be adjusted vertically and transversely by sliding the bolt 19 up or down in the slot 18. Normally the nuts 21 and 22 are set to space the bracket 13 some 6 cm to 8 cm from the mounting surface 10. Hence it is merely necessary for the concrete contractor to position the channels 12 so they extend horizontally generally where a mount 9 is to be secured, as any fine adjustment can be made during final installation. Prior to such installation the channels 12 present no hazard to work on the project, and themselves are well protected against damage.

The tightening device 24 comprises an outer guide part 25 of solid metallic construction welded atop the upper bracket 16 and a Z-shaped clip part 26 slidable horizontally and transversely in the guide 25. The two parts 25 and 26 have respective upright webs 27 and 28 through which a bolt 31 carrying a nut 32 engages, and the part 26 has a lower leg 29 lying on the part 25 and an upper leg 30 parallel thereto and projecting from the guide part 25 toward the wall 10. The nut 32 is normally welded to the web 26 so that the bolt 31 can be turned to displace the part 26 horizontally and transversely in the part 25.

The cover panel 8 itself has inwardly open channels 33 and 34 at its upper and lower edges, each formed on its lower flange with a drip edge 35. In addition the lower end of the bar 14 has a bent up end 23 shaped to fit against the outer flange of the lower channel 34 when the panel 8 is fitted in place as shown in FIG. 2 on the element 14. In this position the upper flange 33, which may be provided like the bottom flange with a rigidifying liner 36, 34, engages over the upper leg 3 of the movable latch part 26.

The cornice assembly described above is installed as follows:

First of all it is presumed that the concrete contractor has embedded two of the channels 12 in the slab face 10 at longitudinal spacings that do not vary by more than one-half the channel length from the length of the panels 8 being used, and that do not vary from vertical alignment by more than one half of the vertical height of the slits 18. Then the bolts 19 are inserted into these channels 12 and are locked tight by their nuts 20 on longitudinal centers that exactly correspond to the panel length. The nuts 21 are then screwed down on the bolts so their outer faces lie at the desired spacing from the surface 10, or more normally the nuts 21 of the two end bolts 19 of the cornice 7 are thus adjusted and the intervening ones are set by a sighting or by means of a line drawn between them. This is of course done with both the top and bottom bolts 19, in perfect vertical alignment.

The brackets 13 are then fitted to the bolts 19 and the nuts 22 mounted, but only tightened when the vertical position of these brackets 13 has been verified. This produces a series of mounts 9 that are in perfect line with one another, and that are spaced apart exactly by the length of the panels 8 to be used. It is also of course possible to provide extra mounts 9 between them, so as to support panels 8 in the middle, and to secure them along a curved line if the installation requires it and the panels 8 can conform.

Then the panels 8 are hung in place, with two panels 8 butting ends longitudinally at each mount 9. This is done by first hooking the lower channel 34 over the lower bar end 23, and then over the upper clip part 30. Once everything is generally in the right position, a worker moves down the line tightening the bolts 31 to pull in the clip parts 30, thereby snugging each panel 8 up at each end on the respective mount 9. Like most of this operation, this step can be carried out from atop the slab 11.

This type of cornice can therefore be mounted as the last finishing step of the public work or construction project. Prior to its being completed, the surface 10 of the slab 11 is smooth, only interrupted by the exposed open sides of the channels 12. Thus the slab 11 can be worked on and cast with ease, and with no possibility of damaging the panels 8 or mounts 9, since they are not installed yet. The finished cornice can be completely smooth and uninterrupted, with no visible fastenings. Due to its relative thinness and the fact that the ends meet at the mounts 9, minor misalignments are invisible, especially if the bar 14 against which the panel ends are snugly engaged is of the same color as the panels 8.

Figure 6:
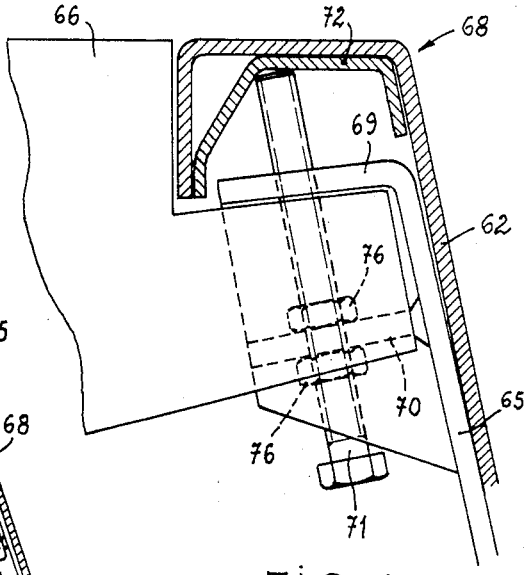
FIG. 6 is a large-scale detail view of the tensioning device of the cornice of FIG. 5.

In FIGS. 5 and 6 a cornice 57 is provided which is set up to enclose a polyester gutter or drainage channel 58 and which is mounted on a vertical surface 60 of a projecting edge 61 by channels 12 as described above.

Here the bracket part 16 has an offset lower part 64 and upper arm 66 carrying a bar 65 so as to fit with a much deeper concave panel 62 having lower and upper channel edges 61 and 68. In addition the lower part 64 carries a vertically adjustable arm 67 on which the gutter trough 58 is mounted. The bracket 16 also has an upper strut 74 that can support a grate 73, and may be extended upward as a railing post 76. The upper edge of the panel 62 may similarly be built up to form a kick stop 75.

The fastener or tensioner shown in detail in FIG. 6 comprises a bolt 71 extending through a hole in a web 70 of the bracket arm 66 and engaging through a hole in the bent-in upper end of the bar 69. The end of this bolt 71 engages vertically up against a stiffener/liner 72 of the upper edge 68 and operates like the system 24 of FIGS. 2 through 5 to secure the concave panel 62 in place.

This arrangement is mounted much like those described above, except that before the panels 62 are hooked on the gutter 58 is secured in place on an incline so it drains, and is caulked. Once the panel 62 is secured in place the grates 73 are dropped down on the struts 74 to close off the interior of the cornice thus formed.

Figure 7:
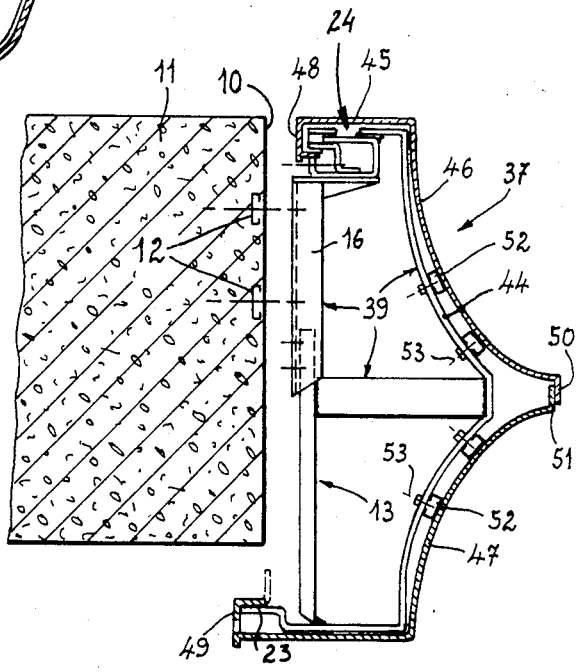
FIG. 7 is a vertical cross section through a third cornice according to this invention.

FIG. 7 shows a cornice 37 where structure identical to that of FIGS. 2 through 4 is assigned the same reference numerals.

In this system a panel 46, 47 is provided having two similar parts 46 and 47 that can be of different colors, shapes, and/or materials. The panels 46, 47 have bent-over channel edges 48 and 49 and opposite overlapping edges 50 and 51 that can be secured together.

The panels 46, 47 are held in place on brackets 39 having appropriately shaped bars 44. In addition the panel parts 46 and 47 are provided with inwardly open bolt channels 52, like the channels 12, so that they can be secured to the bar 44 by means of bolts 53.

This cornice is assembled by securing the mounts 39 as described above for the mounts 9. Then the lower edge 49 of the panel 46, 47 is hooked over the bent-in end 23 and the upper channel 48 is hooked over the latch/tensioner 24. The bolts 53 are inserted and tightened, and the bolt of the latch 24 is similarly tightened to secure the entire assembly solidly together.

Figure 8:
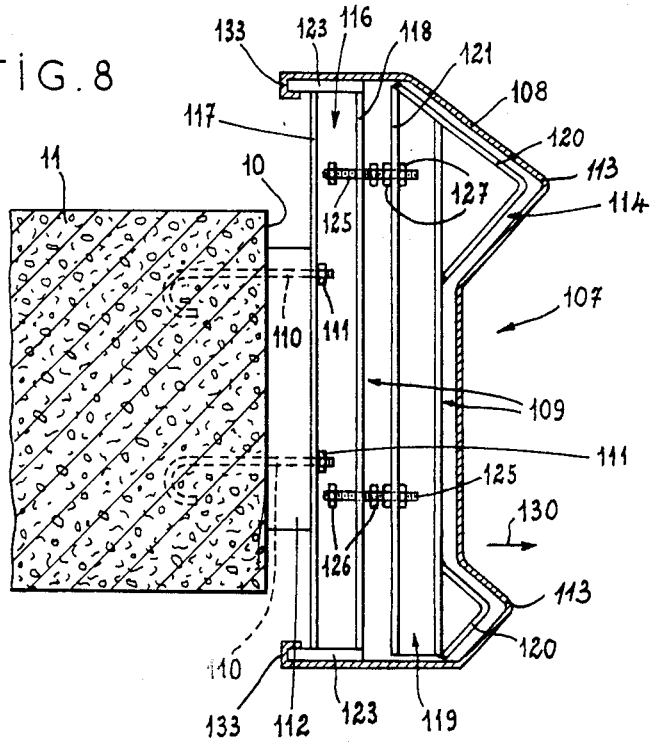
FIGS. 8 and 9 are vertical cross sections through a fourth cornice according to this invention in the partially and fully mounted positions, respectively.
Figure 9:
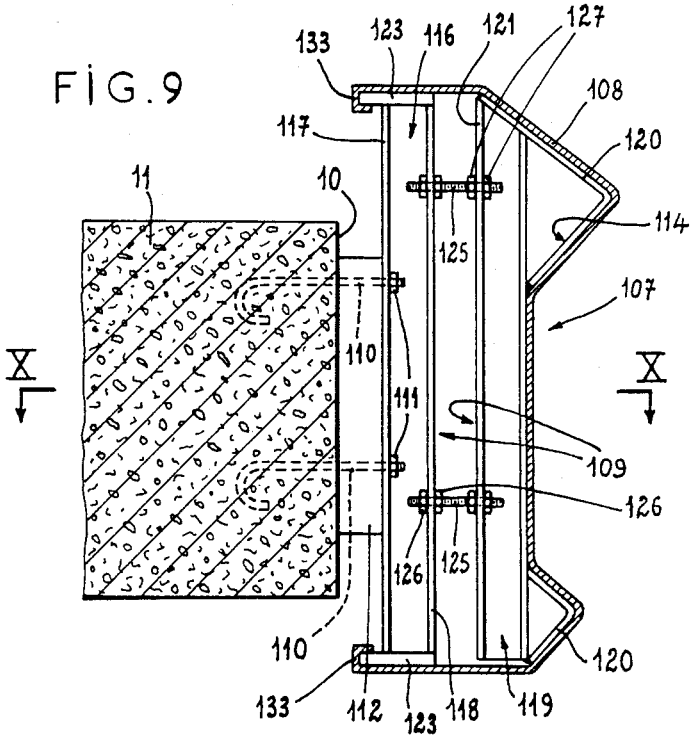
Figure 10:
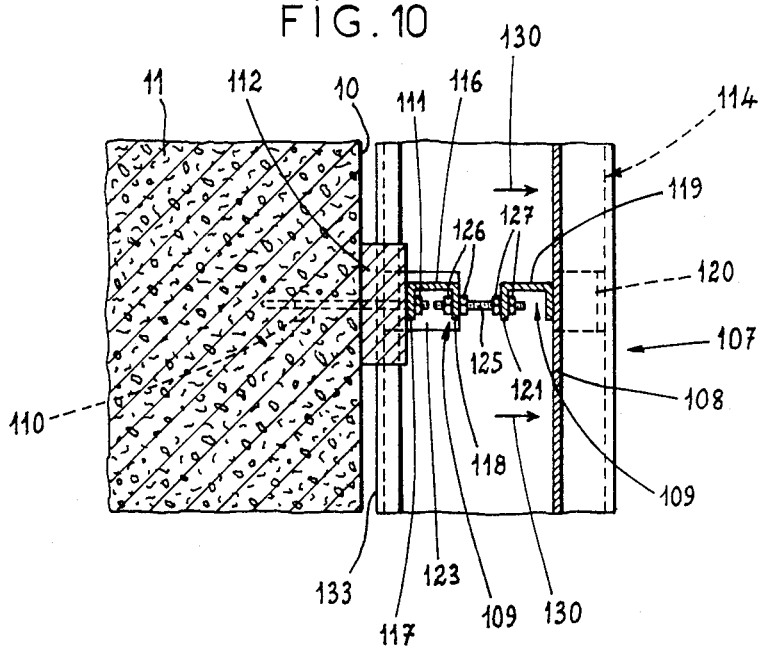
FIG. 10 is a section taken along line X ——X of FIG. 9.

In the system of FIGS. 8 through 10 a cornice 107 formed basically of a skin panel 108 and mounts 109 is secured to the edge 10 of the slab 11.

The panel 108 here is formed with a pair of parallel ridges 113 concave toward the slab 11, the upper ridge being bigger than the lower one. It also has turned-in upper and lower ends 133.

The mount 109 is formed by a stationary part 116 and a movable part 114. The stationary part 116 is a vertical U-section bar open as seen in FIG. 10 parallel to the surface. Its one flange 117 is traversed by bolts 110 imbedded in the concrete, and spacers 112 are provided so that nuts 111 can draw the part 116 tightly into position against these spacers 112, at the desired distance from the surface 10. The movable part 114 has another U-section channel 119 open longitudinally like the channel 116 and provided with bumps 120 that are complementary to the ridges 113.

Bolts 125 extend through the outer flange 118 of the part 116 and the inner flange 121 of the element 119 and carry inner lock nuts 126 flanking the former and outer lock nuts 127 flanking the latter. Before mounting the panel 108 in place the outer one of the inner nuts 126 is backed out so as to allow the panel 198 to be fitted around upper and lower engagement tabs 123 carried on the part 116. Then the outer one of the nuts 126 is screwed inward to move the movable part 114 outward as indicated by arrow 130 to tighten the entire assembly as shown in FIG. 9. The resultant structure is extremely rugged, yet has no outwardly visible fastenings. Like the other cornices described above, the spaced mounts ensure good ventilation of the entire structure so it can be expected to have a long service life.

I claim:

1. A cornice for a construction work having an upright surface, the cornice comprising:

a plurality of similar, elongated, and flexible panels of like section and predetermined length, the panels being laterally concave and having a pair of parallel longitudinal edges and opposite longitudinal ends;

a plurality of respective rigid mounts each generally complementary to the concave section of the panels;

means for anchoring the mounts on the surface spaced apart by a distance equal to the length of the panels;

means including interengaging formations on the mounts and on the edges of the panels for hooking the panel edges to the mounts, one of the mount formations being movable on the mount with the respective edge formation; and tensioning means for displacing the one movable formation on the mount and thereby pulling the respective panel snug against the mount and also securing the respective panel to the respective mount.

2. The cornice defined in claim 1 wherein each mount comprises:

an outer mount member of a convex shape complementary to the concave section of the panels; and an inner bracket fixed on the outer mount member, the anchoring means being secured to the inner bracket and the formations being in part on the outer mount member.

3. The cornice defined in claim 2 wherein each bracket is formed with at least one vertically elongated and horizontally throughgoing slot, the anchoring means being accessible from atop the work and each including:

means forming a horizontally extending groove in the surface;

a bolt having a head captured in but horizontally slidable along the groove and a threaded shank projecting horizontally and transversely therefrom through the respective slot; and nuts threaded on the shank and fixing the bolt in the groove and fixing the bracket on the shank, whereby the bracket can move transversely both horizontally and vertically on the bolt and the bolt can move longitudinally in the groove for three-dimensional adjustability.

4. The cornice defined in claim 2 wherein the formations on the panels include bent-over inwardly open edge portions.

5. The cornice defined in claim 4, further comprising respective inserts of substantially greater rigidity than the panel lining the bent-over edge portions and engaging the formations of the respective mounts.

6. The cornice defined in claim 4 wherein the outer members are upright and each have a lower end forming the respective mount formation and engaged in one of the respective bent-over edge portions, the tensioning means each including a tensioning part forming the respective movable mount formation and engaging in the other bent-over edge portion of the respective panel for displacing the respective one edge portions on the mounts.

7. The cornice defined in claim 6, further comprising respective threaded members accessible from the construction work and operatively engaged between the mounts and the tensioning parts for relatively displacing same.

8. The cornice defined in claim 2 wherein the tensioning means each include:

means for relatively displacing each outer member and the respective bracket horizontally and transversely, the formations of the mount being on the bracket.

9. The cornice defined in claim 8 wherein the last-mentioned means includes a threaded shaft fixed in one of the bracket and outer member and engaged through the other of the bracket and outer member, and nuts carried on the shaft and engageable with the other of the bracket and outer member.

10. The cornice defined in claim 1, further comprising respective spacers between the mount and the surface

11. The cornice defined in claim 1 wherein each panel is formed with an inwardly open longitudinal groove, the cornice further comprising:

bolts captured in the grooves and secured in the mounts for holding the panels on the mounts.

12. The cornice defined in claim 1 wherein the panels are of sheet metal.

13. The cornice defined in claim 1 wherein the panels are of a synthetic resin.

14. The cornice defined in claim 1 wherein each panel is not substantially deformed by the tensioning means but instead has a shape which is substantially the shape it is to have when secured by the tensioning means to the respective mounts.

15. A cornice for a construction work having an upright surface, the cornice comprising:

a plurality of similar, elongated, and flexible panels of like section and predetermined length, the panels being laterally concave and each having a pair of bent-in longitudinal edges;

a plurality of respective mounts each having an inner bracket and a rigid outer member secured to the inner bracket, generally complementary to the concave section of the panels, upper and lower ends;

means for anchoring the brackets on the surface spaced apart by a distance equal to the length of the panels;

respective tension parts displaceable transversely of the panels on the upper ends of the respective outer member, the panels being hookable with one of their edges on the lower ends of the members and with the other of their edges on the tensioning parts; and tensioning means for displacing the tensioning parts on the respective mounts and thereby pulling the respective panels snugly against the respective outer member and securing the respective panels to the respective mounts.

16. A cornice for a construction work having an upright surface, the cornice comprising:

a plurality of similar and flexible elongaged panels of like section and predetermined length, the panels being laterally concave and each having a pair of bent-in longitudinal edges;

a plurality of respective mounts each having an inner bracket and a rigid outer member secured to the inner bracket, generally complementary to the concave section of the panels, and having upper and lower ends;

means for anchoring the mounts on the surface spaced apart by a distance equal to the length of the panels;

formations on the brackets positioned to fit within the bent-in edges of the panels so that same may be hung on the mounts; and means for relatively horizontally transversely displacing the outer members and the brackets and thereby pulling the respective panels snugly against the respective outer member and securing the respective panels to the respective mounts.

* * * * *